US005473967A

United States Patent [19]

Frey et al.

[11] Patent Number: 5,473,967

[45] Date of Patent: Dec. 12, 1995

[54] VEGETABLE CUTTING SYSTEM

[75] Inventors: Max Frey; Marc A. Frey, both of Portland, Oreg.; Peter C. Smith, Florenceville; Darrell B. Brooks, Stickney, both of Canada

[73] Assignee: McCain Foods Limited, Florenceville, Canada

[21] Appl. No.: 35,814

[22] Filed: Mar. 23, 1993

[51] Int. Cl.[6] ..... B26D 7/06

[52] U.S. Cl. ..... 83/402; 83/22; 83/446; 83/449; 83/865; 83/932; 198/380; 198/493

[58] Field of Search ..... 83/402, 22, 865, 83/418, 53, 177, 446, 449, 932; 198/380, 493, 525

[56] References Cited

U.S. PATENT DOCUMENTS

| | | | |
|---|---|---|---|
| Re. 32,822 | 1/1989 | Hodges et al. | 83/402 |
| 100,049 | 2/1870 | Lutz et al. | 99/592 |
| 497,675 | 5/1893 | Miller | 241/273.2 |
| 782,292 | 2/1905 | Walter et al. | 408/86 |
| 1,094,604 | 4/1914 | Shibata | 83/395 |
| 1,908,220 | 5/1933 | Chapman | 406/92 |
| 2,489,581 | 11/1949 | Mason | 99/537 |
| 2,508,868 | 5/1950 | Ross | 241/276 |
| 2,512,921 | 6/1950 | Daugherty | 83/544 |
| 2,567,248 | 9/1951 | Stahmer | 83/444 |
| 2,715,927 | 8/1955 | Cupper et al. | 269/54.4 |
| 2,826,229 | 3/1958 | Necula | 83/165 |
| 2,904,162 | 9/1959 | Simer | 198/380 |
| 2,947,335 | 8/1960 | Schachet | 83/402 |
| 2,956,838 | 10/1960 | Thoresen | 241/48 |
| 3,108,625 | 10/1963 | Lamb et al. | 83/402 |
| 3,109,468 | 11/1963 | Lamb et al. | 99/589 |
| 3,116,772 | 1/1964 | Lamb et al. | 83/27 |
| 3,152,500 | 10/1964 | Watts | 83/302 |
| 3,211,202 | 10/1965 | Mason | 99/592 |
| 3,361,173 | 1/1968 | Lamb | 83/23 |
| 3,799,023 | 3/1974 | Brignard et al. | 83/663 |
| 3,874,259 | 4/1975 | Chambos et al. | 83/408 X |
| 3,952,621 | 4/1976 | Chambos | 83/733 |
| 4,073,060 | 2/1978 | Hendricks | 30/279 R |
| 4,082,024 | 4/1978 | Hodges et al. | 83/402 |
| 4,135,002 | 1/1979 | Hodges et al. | 426/482 |
| 4,190,208 | 2/1980 | Schaeffer et al. | 241/192 |
| 4,198,887 | 4/1980 | Williams, Jr. | 83/365.3 |
| 4,367,667 | 1/1983 | Shibata | 83/365.3 |
| 4,372,184 | 2/1983 | Fisher et al. | 83/98 |
| 4,387,111 | 6/1983 | Mullindar | 426/615 |
| 4,393,737 | 7/1983 | Shibata | 83/365.3 |
| 4,423,652 | 1/1984 | Winslow | 83/24 |
| 4,614,141 | 9/1986 | Mendenhall et al. | 83/404.3 |
| 4,619,192 | 10/1986 | Cyryk et al. | 99/538 |
| 4,628,808 | 12/1986 | Simon | 99/538 |
| 4,644,838 | 2/1987 | Samson et al. | 83/865 |
| 4,704,959 | 11/1987 | Scallen | 99/538 |
| 4,807,503 | 2/1989 | Mendenhall | 83/22 |
| 4,911,045 | 3/1990 | Mendenhall | 83/98 |
| 4,926,726 | 5/1990 | Julian | 83/165 |
| 4,979,418 | 12/1990 | Covert et al. | 83/865 |

(List continued on next page.)

FOREIGN PATENT DOCUMENTS

| | | |
|---|---|---|
| 680486 | 2/1964 | Canada . |
| 1308000 | 9/1992 | Canada . |
| 59075 | 1/1982 | European Pat. Off. . |
| 377451 | 11/1990 | European Pat. Off. . |
| 377075 | 11/1990 | European Pat. Off. . |
| 842420 | 6/1952 | Germany . |
| 333015 | 8/1930 | United Kingdom . |

*Primary Examiner*—Eugenia Jones
*Assistant Examiner*—Kenneth E. Peterson
*Attorney, Agent, or Firm*—Seyfarth, Shaw, Fairweather & Geraldson

[57] ABSTRACT

Potatoes are conveyed one at a time along a predetermined path ending at a cutter that cuts the potatoes into helical strips. A series of four rings surrounds the path. Each ring has a plurality of nozzles that produce jets of water intersecting at a point in the path. At the outlet of the series of four rings is an orienter through which the potatoes pass. The rings and the orienter align and guide the potatoes as they move along the path and through the cutter.

40 Claims, 7 Drawing Sheets

U.S. PATENT DOCUMENTS

| | | | |
|---|---|---|---|
| 5,010,796 | 4/1991 | Mendenhall | 83/865 |
| 5,035,915 | 7/1991 | Mendenhall | 426/637 |
| 5,042,342 | 8/1991 | Julian | 83/98 |
| 5,097,735 | 3/1992 | Mendenhall | 83/865 |
| 5,123,521 | 6/1992 | Mendenhall | 198/626.4 |
| 5,133,687 | 7/1992 | Malloy | 83/53 X |
| 5,174,181 | 12/1992 | Julian et al. | 83/24 |
| 5,179,881 | 1/1993 | Frey et al. | 83/98 |
| 5,201,259 | 4/1993 | Covert et al. | 83/865 |
| 5,211,098 | 5/1993 | Mendenhall | 83/865 |
| 5,211,278 | 5/1993 | Mendenhall | 198/626.4 |

147
141
143
140
142
145a
145
145a
144
145a
146
145a
81
81a
81a
81a 160
164
162
164
150
159
158
156
157
151
154
155
153
152
159
158
163
161
163
165

VEGETABLE CUTTING SYSTEM

BACKGROUND OF THE INVENTION

This invention relates to a mechanism that delivers vegetables to a cutter for slicing them.

Potatoes and other vegetables may be sliced transversely, for example, into helical strips. One type of prior-art system comprises a mechanical device to deliver the vegetables to the cutter. In another prior-art system, the vegetables are mixed with water, and are hydraulically delivered horizontally through a tapered, elastomeric conduit to a cutter. A third type of prior-art system hydraulically delivers the potatoes vertically, through a tapered, elastomeric conduit to a mechanically rotated cutter. A fourth type of prior art system is disclosed in U.S. Pat. No. 5,168,784.

The performance of these prior art systems is not as high as it could be. "Performance" is dictated by three criteria. The first criterion is referred to as "throughput" which basically refers to the quantity of vegetables that is cut. It is important that the throughput be as high as possible. However, two other considerations can limit the throughput. One is quality, and the other is yield. Besides the cut quality criteria normally employed in french fry processing, an additional quality aspect is considered in the processing of helical french fries. This additional quality aspect relates to the number of coils produced of one turn or greater versus the smaller segments less than one complete coil, or the smaller pieces produced. The fewer the smaller pieces and segments less than one coil, the higher the quality. The second consideration, yield, has the normal meaning when used in french fry processing, that of acceptable quality produced versus the amount of incoming raw potatoes to the process line.

In the prior art systems identified above, the throughput is generally maintained low in order to maximize the quality of the cut and the yield.

SUMMARY OF THE INVENTION

It is, therefore, an important object of the present invention to improve the throughput without adversely affecting the quality of the cut and the yield.

It is an important object to provide a delivery mechanism whereby potatoes are applied to the cutter more gently and at the same time maintaining high throughput, cut quality and yield.

Another object is to provide a system which will cut vegetables into slices, such as helical strips, in an improved way.

Another object is to stabilize or orient the vegetables as they proceed to and through the cutter.

Another object is to stabilize, orient and centralize the vegetables as they proceed to and through the cutter.

In summary, there is provided a vegetable cutting system comprising means for conveying vegetables to a point defining the start of a predetermined path, at least one set of nozzle means arranged around the path for generating jets of water intersecting at a point in the path, and cutting means at the end of the path.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figures 1, 3, 4, 5:
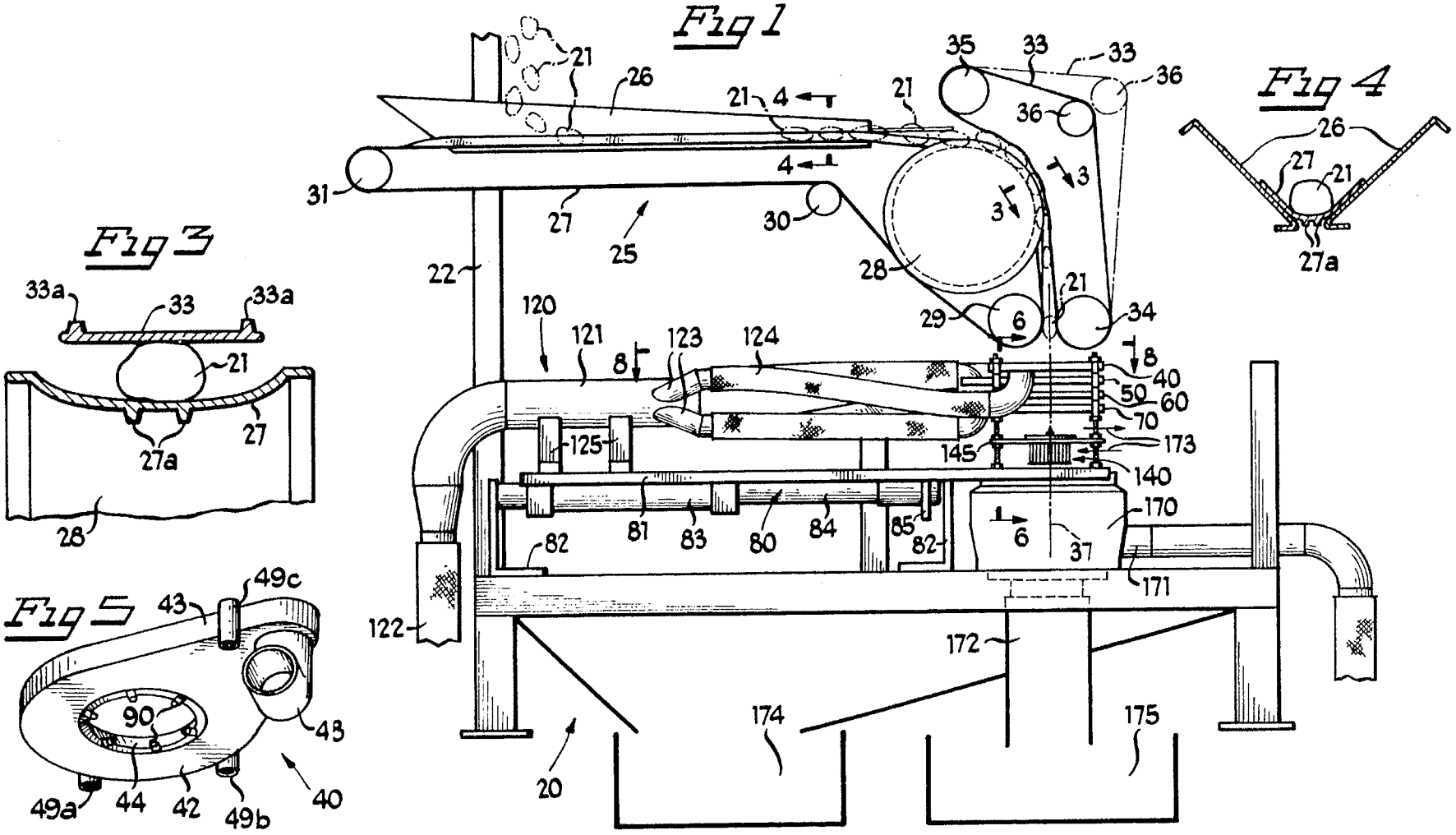
FIG. 1 is a side elevational view of a system for producing helical potato strips incorporating the features of the present invention.
FIG. 3 is an enlarged sectional view taken along the line 3—3 of FIG. 1.
FIG. 4 is an enlarged sectional view taken along the line 4—4 of FIG. 1.
FIG. 5 is a perspective view on an enlarged scale of the top one of the rings of the guiding system.

Turning now to FIG. 1, there is depicted a system 20 for cutting potatoes into generally helically shaped strips and incorporating the features of the present invention. It is to be understood that vegetables other than potatoes could be processed in system 20 and they could be cut into shapes other than helically shaped strips. Potatoes 21 are preferably of a variety having a long axis and a generally round cross section, for example, like the Russet Burbank variety of potato. Of course, many kinds of potatoes may be processed by system 20. Before being applied to system 20, the potatoes may be fed via a typical french fry process line which may or may not include cleaning, washing, de-vining, peeling, scrubbing, brushing, preheating, defect removal, and any other processing steps which may be appropriate preparation prior to the cutting of the potatoes into helical strips. After being cut into helical strips, they are further processed, including one or more of grading, blanching, sugar flume, drying, frying, freezing, grading and packaging. The system herein is not limited to only these processing steps, and additional processing steps can be added which may be deemed appropriate to the production of the product.

Potatoes 21 may be sized into various groups depending on their cross dimensions.

System 20 comprises a conveying mechanism 25 which includes a trough 26 that is tapered in order to singulate the potatoes, that is, placed in single file. An endless main belt 27 lies on the bottom of trough 26 and passes around a large main wheel 28, an outlet pulley 29 and additional pulleys 30 and 31. The outer surface of wheel 28 can be dished or concave as can be seen in FIG. 3. Belt 27 has ribs 27*a* which mate with V-grooves in main wheel 28, as show in FIG. 3. Conveying mechanism 25 also includes a secondary belt 33 which extends around an outlet pulley 34 and additional pulleys 35 and 36. Belt 33 has ribs 33*a* which mate with grooves in pulleys 34, 35 and 36. One or more of pulleys 34 and 35 and 36 can actually consist of a pair of pulleys in tandem. Ribs 33*a* would respectively reside in the V-grooves of such pulley pairs. The location of pulleys 34 and 35 is such as to cause secondary belt 33 to continuously bear against the adjacent portion of main belt 27. Pulley 36 is laterally movable, as shown by the dotted line, and, therefore, provides a means for controlling the force by which belt 33 presses against belt 27. The farther out pulley 36 is, the greater the pressure between belts 27 and 33. One or more of the pulleys are driven so that both belts are continuously moving. As shown in FIG. 4, the singulated potatoes rest upon main belt 27 which brings them toward the nip between belts 27 and 33.

The potatoes are held by the two belts as they are projected or fall along a predetermined path 37. The path may be horizontal or the path may be vertical as in the embodiment depicted in the drawings. The path may be at any angle between horizontal and vertical. It is substantially straight if vertical and curved to some extent because of the force of gravity when it is other than vertical. The moving belts 27 and 33 fling or project the potatoes along such path. The potatoes are projected from conveying mechanism 25 at a speed related to the speed of the cutter, as will be described. In a particular embodiment, the speed is about 270 feet per minute. It is understood, however, that the speed can be varied and adjusted to suit optimum flow conditions of maximizing throughput at good yield and cut quality.

Figure 2:
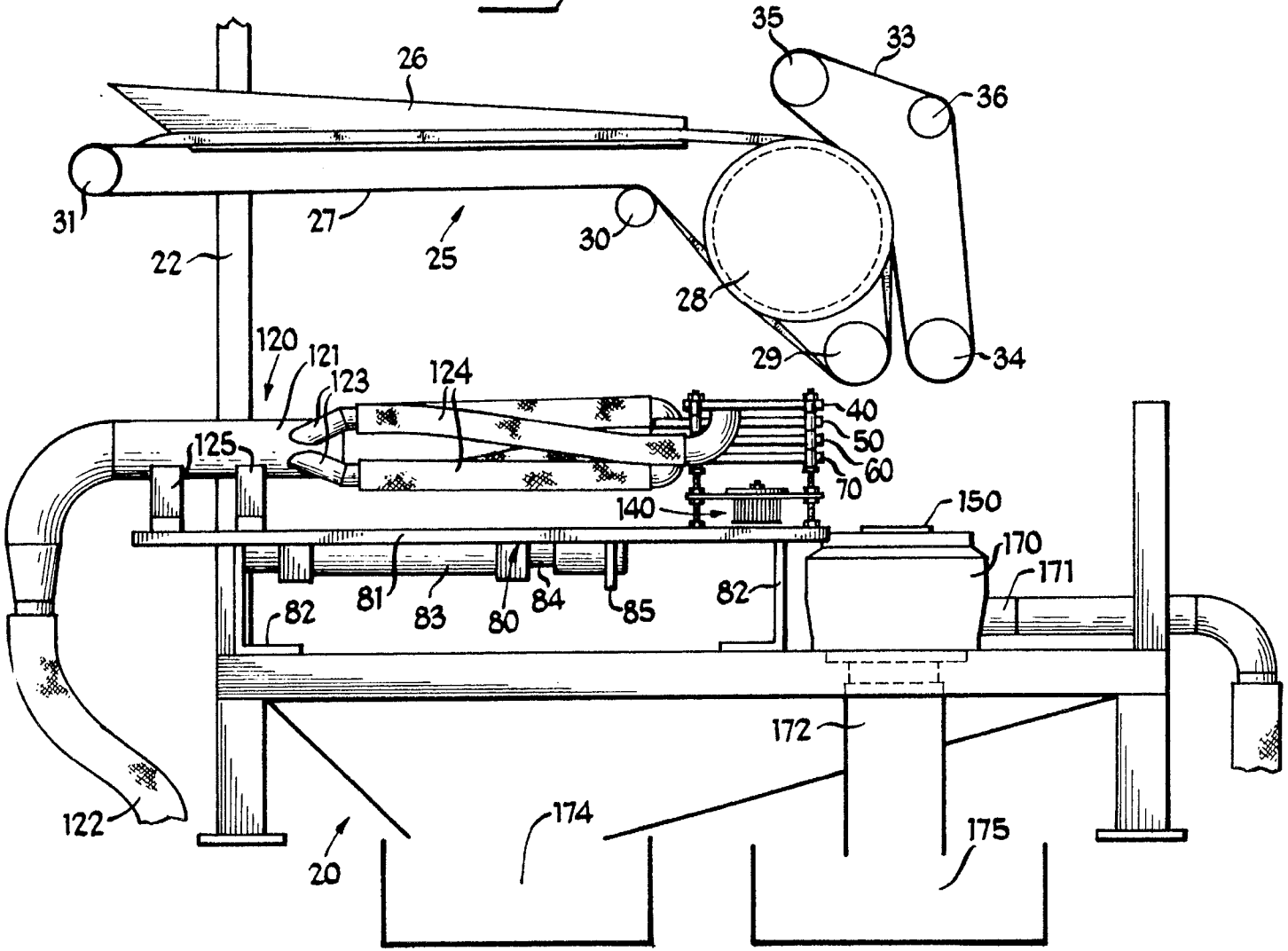
FIG. 2 is a view like FIG. 1 but with the guiding system and manifold in their retracted positions to enable access to the turbine.
Figure 6:
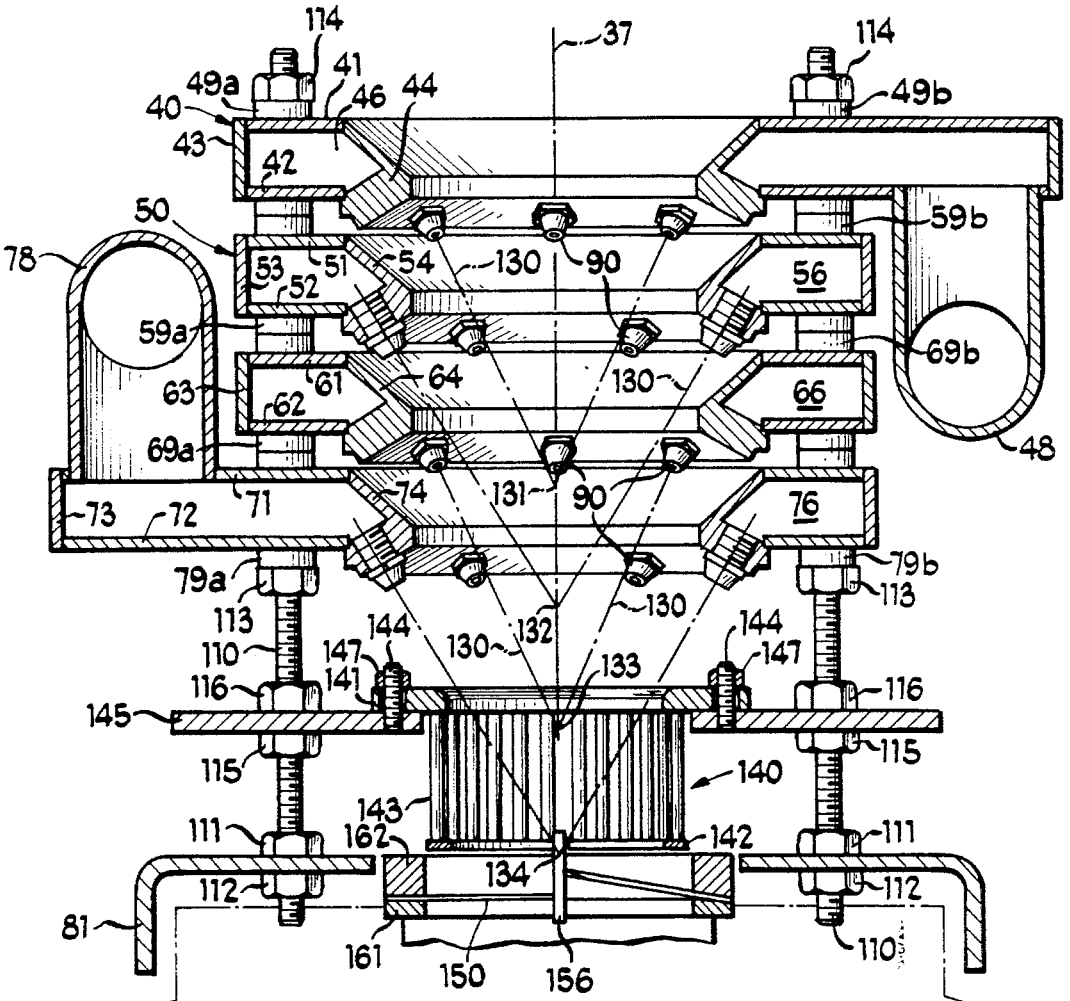
FIG. 6 is an enlarged view in vertical section taken along the line 6—6 of FIG. 1 with the turbine shown in phantom.

The potatoes are projected or delivered into a water-guide mechanism including a series of four rings 40, 50, 60 and 70. Each ring carries a plurality of nozzles, which will be described in further detail, that serve to guide, orient and centralize the potatoes as they move along path 37. The series of rings 40, 50, 60 and 70 is mounted on a carriage 80 which includes a long base 81 that is U-shaped in transverse cross section (FIG. 6). Base 81 is movable on a track system (not shown) carried by supports 82 (FIG. 1). A cylinder 83 is mounted on frame 22, its associated piston 84 being attached at its forward end to base 81 by means of a flange 85. When it is desired to move carriage 80 to the left, cylinder 83 is operated, causing piston 84 to move to the left and thereby move carriage 80 also to the left, as can be seen in FIG. 2.

System 20 further comprises a water delivery system 120 which includes a manifold 121 having its inlet connected by a hose 122 to a source of water (not shown). Manifold 121 also includes four outlets 123, two of which are visible in FIG. 1. The four outlets are connected by means of hoses 124 to rings 40, 50, 60 and 70, respectively. Water delivery system 120 is mounted on base 81 by means of saddles 125.

A stabilizer or orienter 140 orients and stabilizes the potatoes passing through it.

At the end of path 37 is a cutter 150 which can be rotated by a water-driven turbine 170 having a construction such as described in U.S. Pat. No. 5,179,881 assigned to the assignee of this application. Turbine 170 has a water outlet 171 and a product outlet 172. Water delivered by the guide mechanism, consisting of the series of the four rings, is, in part, directed laterally, as indicated by arrows 173, along with potato scraps. Water with potato scraps entrained therein fall into chaff flume 174. Water with the cut potatoes is directed through product outlet 172 to product flume 175.

Figure 7:
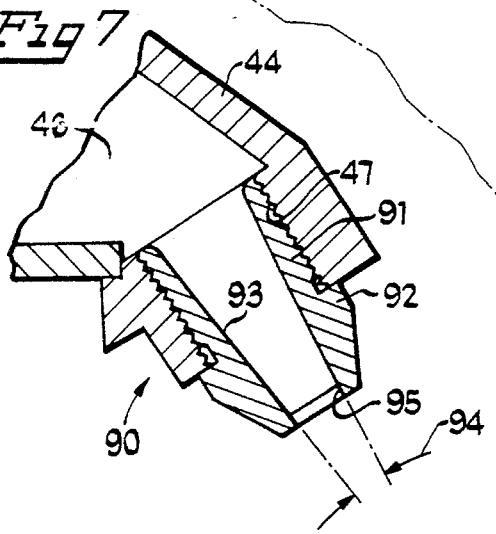
FIG. 7 is an enlarged sectional view of one of the nozzles and its associated ring.

Turning now to FIGS. 5 and 6, further details of the water-guide mechanism (rings 40–70) will be described. Ring 40 is located at the top of the series or stack and is generally ovoid shaped in plan view. It includes a top wall 41 and a bottom wall 42 which are essentially congruent and are each ovoid shaped. An outside wall 43 closes the outside of ring 40. An inside ring-like wall 44, which is essentially V-shaped in transverse cross section, closes the inside of ring 44 thereby defining a chamber 46. The lower surface of wall 44 is inclined and has a set of six equiangularly spaced threaded bores 47 (FIG. 7). Protruding from bottom wall 42 and attached thereto is an elbow 48 having a passageway which communicates with chamber 46. Welded to outside wall 43 are three bushings 49*a*, b and c.

Referring to FIG. 7, associated with ring 40 are six nozzles 90, each of which has a threaded body 91 and a wrenching surface 92. Nozzles 90 are mounted within bores 47 in ring 40. Nozzle 90 has a bore 93 defined by a frustoconical surface at an angle 94, of 12° in the embodiment depicted.

Figure 8:
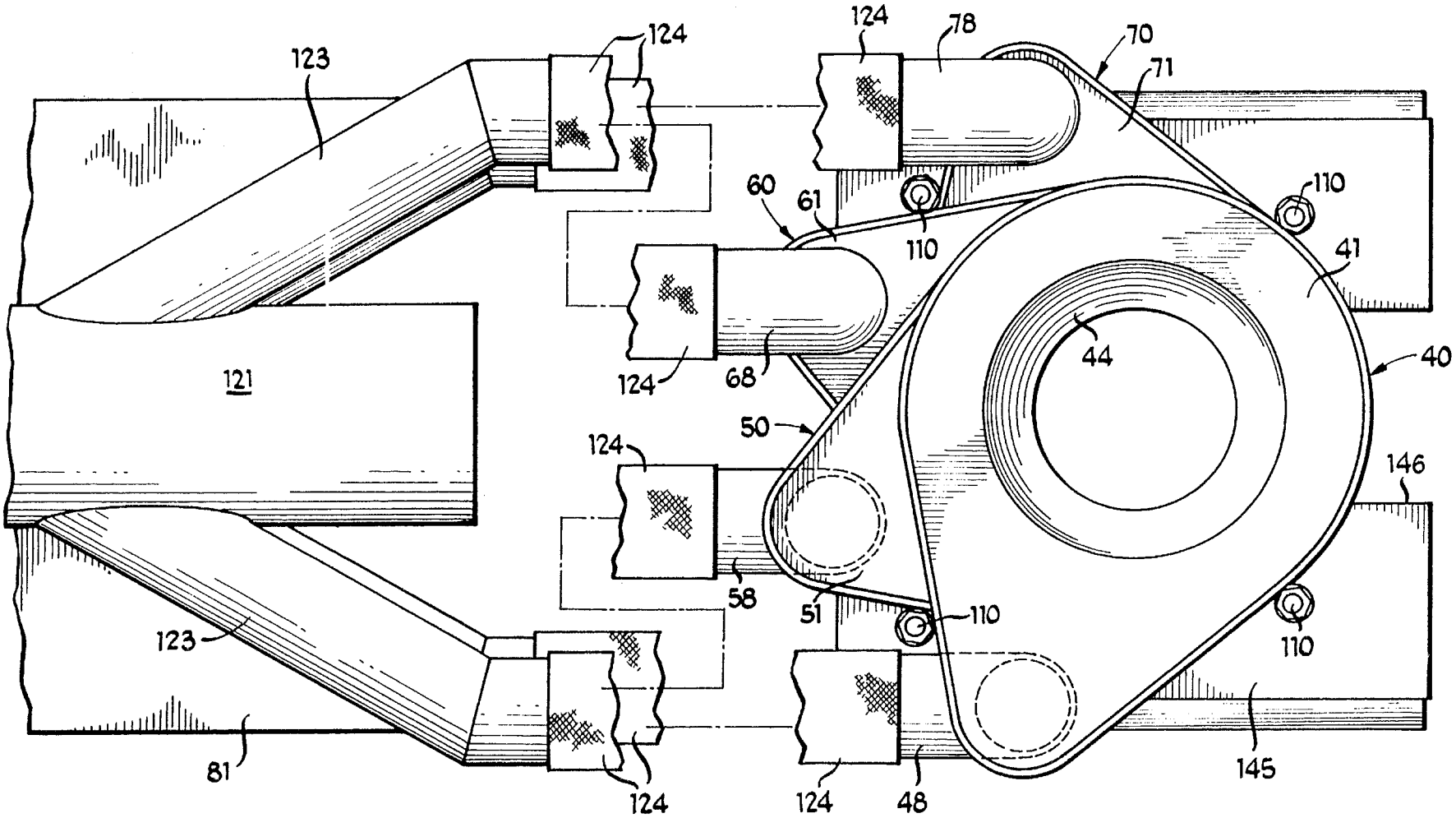
FIG. 8 is an enlarged plan view of the guiding system and the water delivery system taken along the line 8—8 of FIG. 1, but with the hoses shown fragmented.

Referring back to FIG. 6, water under pressure exits mouth 95 to create a water jet 130. Nozzles 90 are preferably equiangularly spaced about wall 44 and, therefore, there is a 60° spacing between them. The other three rings 50, 60 and 70 have substantially the same construction as ring 40. The parts of rings 50, 60 and 70 bear corresponding reference numerals to those of ring 40 to the extent these parts are visible in any of the figures. There are some differences. The orientations of elbows 48, 58, 68 and 78 differ, as can be seen in FIG. 8. Elbows 48, 58, 68 and 78 are located such that the axes of their horizontal portions are substantially parallel as can be seen in FIG. 8. Also, the elbows 48 and 58 of the top two rings 40 and 50 are directed downwardly, whereas, for rings 60 and 70, the respective elbows 68 and 78 are directed upwardly.

Rings 40, 50, 60 and 70 are held together by four threaded rods 110. One rod passes through all four bushings 49*a*, 59*a*, 69*a* and 79*a*. A second one of the rods 110 passes through all four bushings 49*b*, 59*b*, 69*b* and 79*b*. In the particular embodiment depicted, a third rod passes through bushing 49*c* of ring 40 and the corresponding bushing of ring 60. A fourth threaded rod 110 passes through the third bushings respectively of the rings 50 and 70. The four rods 110 extend through holes 81*a* (FIG. 9) of base 81 and are attached thereto by means of nuts 111 and 112 (FIG. 6). Nuts 114 are also applied to the upper ends of rods 110, and nuts 113 are applied to such rods beneath the series of rings, thereby firmly attaching the series of rings to carriage 80. It is understood that the above-described manner of connecting the series of rings together and to the carriage is just an example of how mounting can be accomplished.

In an actual embodiment, nozzles 90 in rings 40 and 60 were respectively vertically aligned and nozzles 90 in rings 50 and 70 were respectively vertically aligned. The vertical axes defined by each pair of vertically aligned nozzles 90 in rings 40 and 60 alternated with the vertical axes defined by each pair of vertically aligned nozzles 90 in rings 50 and 70.

Nozzles 90 in rings 40 and 60 were 30° offset from those in rings 50 and 70.

As previously described, water through manifold 121 is directed through elbows 48, 58, 68 and 78 of the four rings, into chambers 46, 56, 66 and 76 of the rings and from there is forced under pressure out of nozzles 90. Referring to FIG. 6, the six nozzles 90 create water jets 130. The six water jets from ring 40 intersect substantially at point 131 in path 37. Similarly, water jets from nozzle 90 in ring 50 intersect at point 132 in vertical path 37, the nozzles in ring 60 produce water jets that intersect at point 133 in such path and the nozzles in ring 70 produce six water jets that intersect at point 134 in vertical path 37. Each water jet 130 is directed toward the cutter, preferably at an acute angle with respect to path 37. It is to be understood, however, that the nozzles need not be all at the same angle nor need they be directed toward the cutter. Certain of the nozzles could be directed away from the cutter. Different nozzles in the same ring could have different inclinations. In an actual embodiment, the angle was 30°. The angle of each water jet with path 37 is substantially the same. The reason that the phantom lines in FIG. 6 are not parallel is because of the 30° offset of the nozzles in rings 40 and 60 with respect to the nozzles in rings 50 and 70.

Each potato is discharged by conveying mechanism 25 down vertical path 37, through rings 40, 50, 60 and 70. Each potato is forced towards a central position and oriented with its longitudinal axis coincident with the center line axis of the rings and the orienter by means of the water jets.

Figures 9, 10:
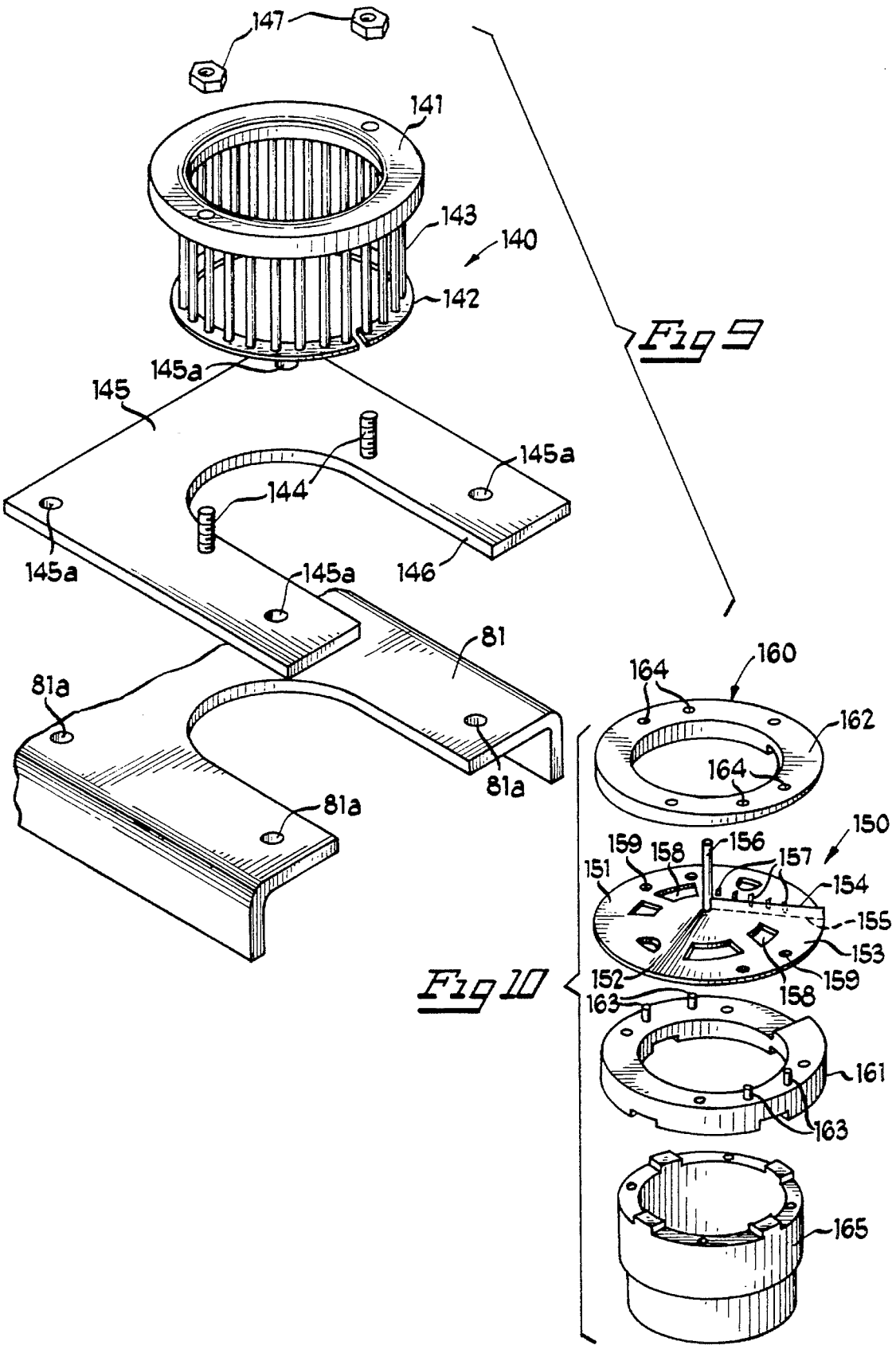
FIG. 9 is an exploded view of the orienter.
FIG. 10 is an exploded view of the cutting structure.

Referring to FIG. 9, orienter 140 includes an upper collar 141, a lower retainer 142 and a plurality of vertical rods 143 arranged substantially in a circle. Each rod may have any cross section, such as round or rectangular. Orienter 140 guides and orients the potato as it engages cutter 150. Preferably, rods 143 are welded to collar 141 and retainer 142. Orienter 140 includes a plate 145 having a cut-out 146 therein. Cut-out 146 removably receives collar 141. Rods 110 pass through holes **145*a* in plate 145. Plate 145 carries bolts 144 that pass through holes in collar 141. Nuts 147 are applied to bolts 144, thereby attaching orienter 140 to plate 145. Referring to FIG. 6, plate 145 is secured in place by means of nuts 115 and 116 on rods 110. The height of plate 145 and the orienter 140 of which plate 145** is a part can readily be adjusted by means of these nuts.

In one embodiment of the invention, different orienters 140 were used, depending on the size of the transverse dimension of the potatoes. Thus, the potatoes may be grouped according to size. When those within a predetermined small range of cross dimensions are processed, an orienter 140 with a relatively small internal diameter ("ID") is used to process potatoes. To process those within a medium range of cross dimensions, the orienter with a medium ID is employed and with the largest potatoes, an orienter with the largest ID is employed. Furthermore, rings 30, 40, 50 and/or 60 may have different sizes depending on the size of the transverse dimension of the potatoes. Thus, with smaller potatoes a smaller set of rings could be used, while with larger potatoes a larger set would be employed. Furthermore, the system may have means to adjust the axial position of the rings to optimize performance.

Orienter 140 maintains the potatoes oriented so that their axes are along path 37, vertical in the particular embodiment depicted. Orienter 140 accommodates passage of the potato therethrough while maintaining its proper orientation, yet accommodating passage of the water from rings 40, 50, 60 and 70, transversely through rods 143.

Referring to FIG. 10, cutter 150 has a portion 151 which is substantially flat and lies in a plane substantially perpendicular to the direction of potato movement, that is, path 37. In other words, portion 151 is substantially horizontal in the particular embodiment depicted in FIGS. 1 to 10. Cutter 150 has a second portion 153, which is inclined upwardly, from fold line 152. In an operating embodiment, portion 151 had an extent of 225° and portion 153 had an extent of 135°. Cutter 150 is slit radially to produce a pair of edges 154 and 155 which are substantially parallel and axially displaced. Edge 154 is sharpened to create a blade. A quill 156 projects axially from the center. Mounted on the upstream face of flat section 151 are five slitter blades 157. Cutter 150 has a number of openings 158 which accommodate passage of water. Also, cutter 150 has mounting holes 159.

Cutter 150 is mounted in a cutter carrier 160, sandwiched between elements 161 and 162. The upper surface of element 161 matches the lower surface of cutter 150 and the lower surface of element 162 matches the upper surface of cutter 150. Pins 163 on elements 161 project through aligned holes 159 in cutter 150 and holes 164 in element 162. Carrier 160 includes a main body 165 keyed into element 161 as indicated. Cutter 150 and cutter carrier 160 mounting same are mounted in turbine 170.

The potatoes are thrown against cutter 150 so that the potato becomes impaled on quill 156. As cutter 150 is rotated by turbine 170, cutting edge 154 slices the potato into a helix and slitter blades 157 slit the helical slice into strips. These strips are delivered through product outlet 172 to the next processing station in the line (FIG. 1).

The speed of the potatoes from conveyor mechanism 25 is adjusted to match the speed of cutter 150. Preferably, the potatoes travel at a higher velocity than they would be processed through cutter 150, in order to impale them on quill 156 and also to push the last piece of the preceding potato through the cutter.

It is important to note that conveying mechanism 25 is the means by which the potatoes are conveyed to cutter 150 along path 37. Rings 40–70 and orienter 140 guide and orient the potatoes along that path. The jets from the nozzles on rings 40–70 prevent or resist rotation of the potato as it is being cut by cutter 150. While rings 40–70 and orienter 140 are depicted as being arranged to orient and guide the potatoes along a vertical path 37, it is to be understood that the configuration of these elements can be modified to orient and guide the potatoes along a path that is horizontal, vertical or any angle inbetween. Orienter 140 also helps to prevent excess tilt of the potato as it is being cut.

When it is desired to replace cutter 150, cylinder 83 is operated to move carriage 80 to the left. As can be seen in FIG. 2, this procedure exposes cutter 150 and cutter carrier 160 (FIG. 10) carrying same. The assembly can then be removed and cutter 150 replaced.

Figure 11:
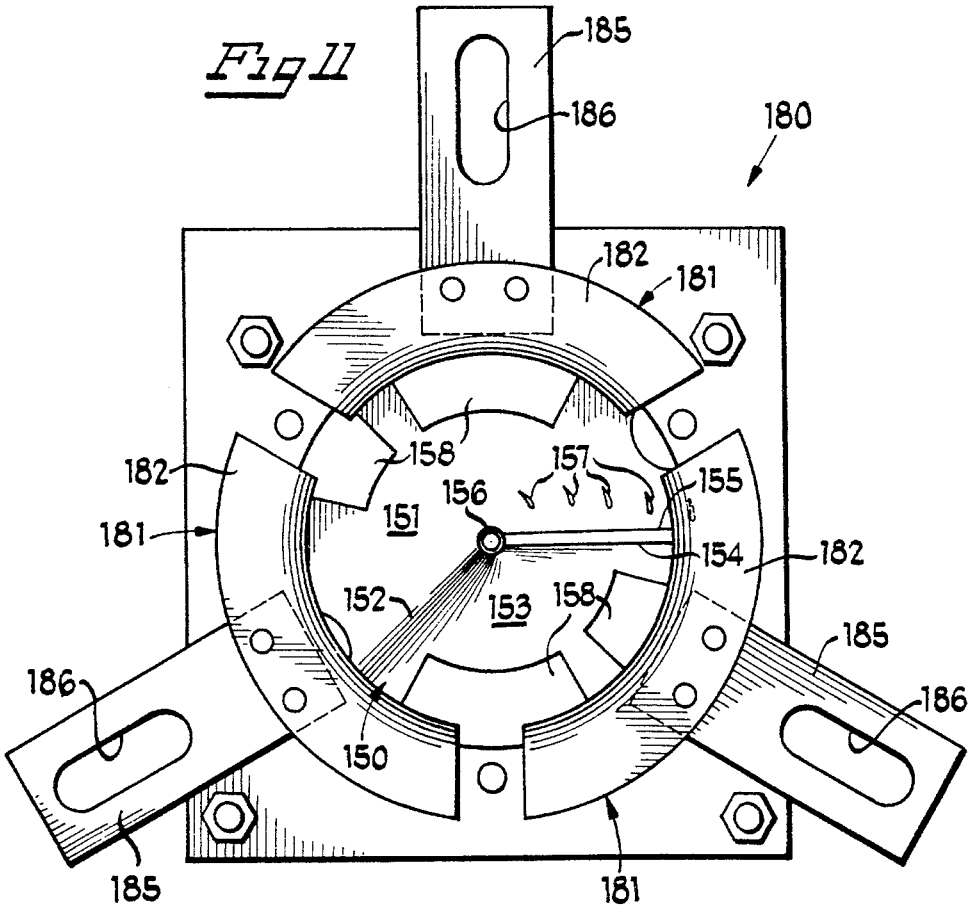
FIG. 11 is a plan view of another embodiment of an orienter.
Figure 12:
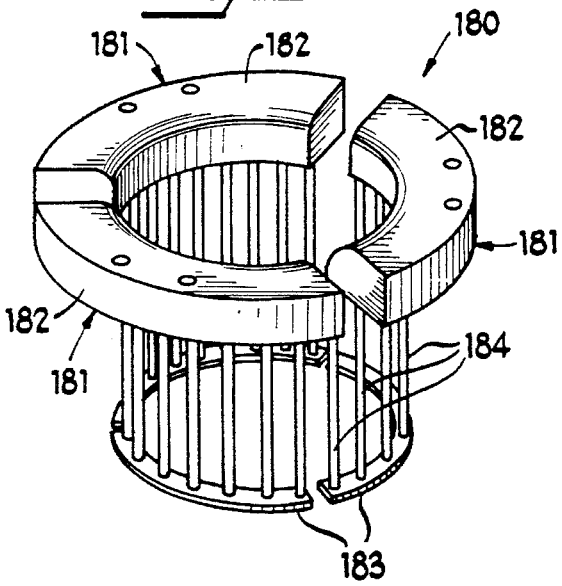
FIG. 12 is a perspective view of a portion of the orienter of FIG. 11.

A second embodiment of an orienter which may be used in system 20 is depicted in FIGS. 11 and 12. Orienter 180 depicted therein includes three substantially identical sections 181, each including an arcuate upper ring segment 182, an arcuate lower ring segment 183 and a plurality of vertical rods 184 therebetween. Attached to each upper ring segment 182 is a plate-like arm 185 having a slot 186. Fasteners are used to attach arms 185 to a mounting plate (not shown). Slots 186 enable ready radial adjustment of each section 181. To process potatoes having a larger transverse dimension, sections 181 could be moved radially to that diameter which best matches the incoming potato size range.

Figure 13:
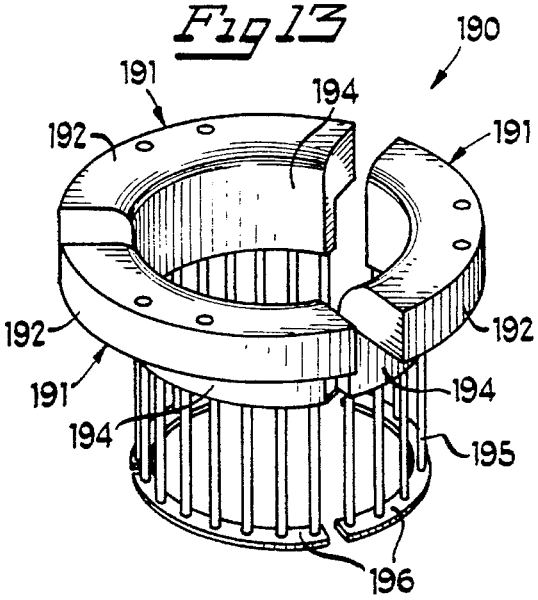
FIG. 13 is a perspective view of yet another embodiment of the orienter.

FIG. 13 depicts yet another embodiment of an orienter 190 also having three sections 191. Each section 191 is defined by an upper arcuate ring segment 191, an arcuate plate 194 depending from each section 191, a plurality of rods 195 depending from each plate 194 and arcuate lower ring segments 196 attached to the rods. Orienter 190 may be mounted in the same way as orienter 180, using a set of arms 185.

Figure 14:
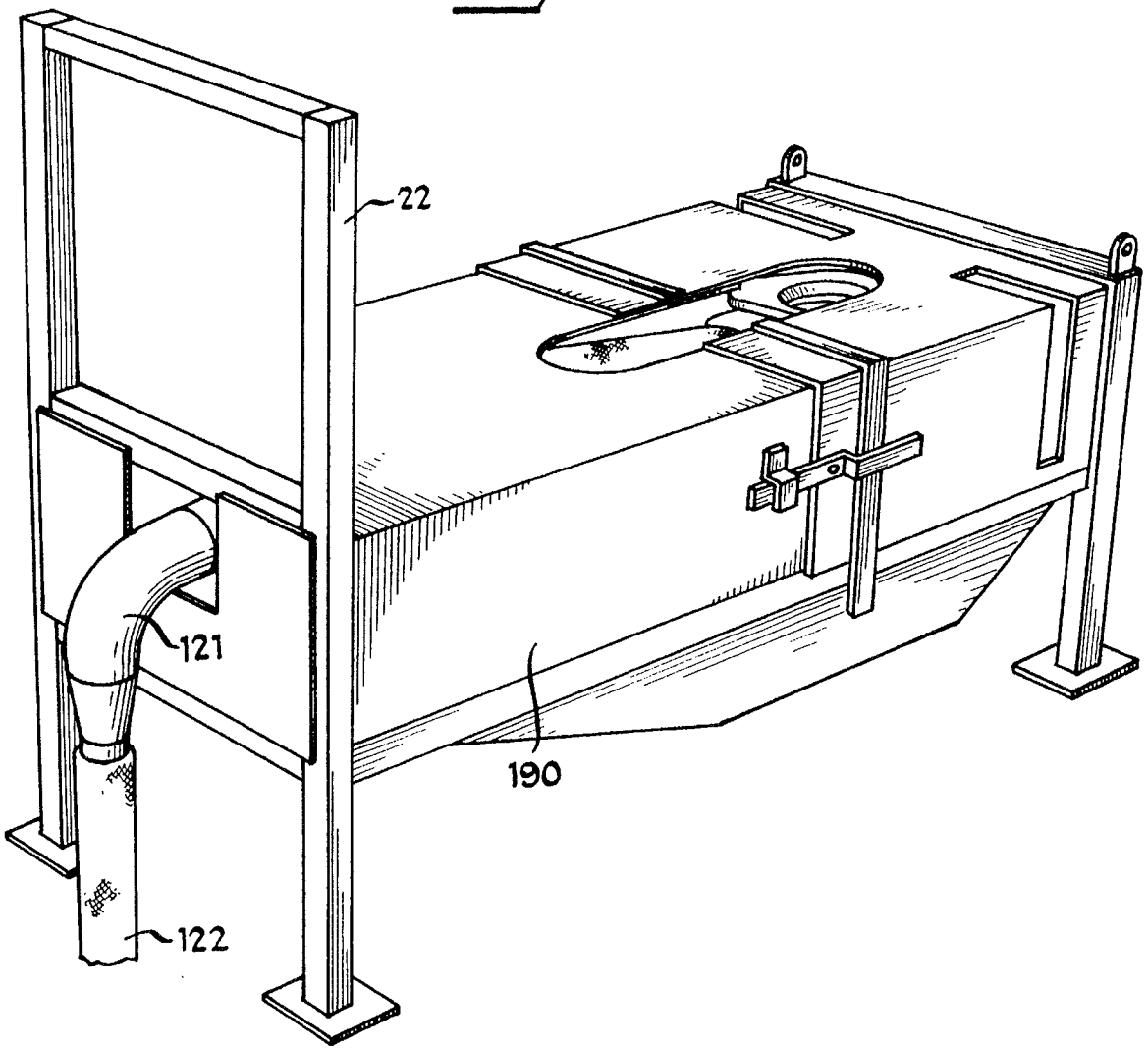
FIG. 14 is a perspective view of the vegetable cutting system with its housing in place.

FIG. 14 depicts cutting system 20 within a removable housing 200 to minimize splashing water during operation.

What has been described therefore is an improved system for slicing vegetables, having specific applicability to cutting potatoes into helical strips. Both the water jet mechanism and the orienter center and align the potatoes as they are delivered to and through the cutter. The combination delivers potatoes to the cutter more gently than prior art systems, in order to provide a better quality cut and higher yield.

While preferred embodiments of the invention have been described, it is to be understood that the scope of the invention is defined by the following claims.

What is claimed is:

1. A vegetable cutting system comprising means for conveying vegetables one at a time to a point defining the start of a predetermined path, cutting means at the end of said path, and at least one set of nozzle means arranged around said path for generating jets of water intersecting at a point in said path for orienting the vegetables with respect to said cutting means.

2. The vegetable cutting system of claims 1, wherein said path is substantially straight and vertical.

3. The vegetable cutting system of claim 1, wherein the orientation of each of said nozzle means is such as to create a jet of water at an acute angle with respect to said path and directed toward said cutting means.

4. The vegetable cutting system of claim 3, wherein said acute angle is about 30°.

5. The vegetable cutting system of claim 1, comprising at least two spaced-apart sets of said nozzle means for generating jets of water intersecting respectively at two points in said path.

6. The vegetable cutting system of claim 5, comprising six nozzle means in each set.

7. The vegetable cutting system of claim 5, wherein said nozzle means of each set are substantially equiangularly spaced apart.

8. The vegetable cutting system of claim 1, and comprising a plurality of spaced-apart sets of said nozzle means for generating jets of water intersecting respectively at a plurality of points in said path.

9. The vegetable cutting system of claim 8, comprising four sets of said nozzle means.

10. The vegetable cutting system of claim 9, comprising six nozzle means in each set.

11. The vegetable cutting system of claim 10, comprising first and second and third and fourth spaced apart sets of said nozzle means for generating jets of water intersecting respectively at four points in said path, the nozzle means of said first and third sets being aligned and the nozzle means of said second and fourth sets being aligned.

12. The vegetable cutting system of claim 11, wherein the nozzle means of said first and second sets are about 30° out of phase with the nozzle means of said second and fourth sets.

13. The vegetable cutting system of claim 10, wherein the velocity of each of said jets of water is greater than the velocity of the vegetables along said path.

14. The vegetable cutting system of claim 1, wherein the velocity of each of said jets of water is 20–40 times the velocity of the vegetables along said path.

15. A vegetable cutting system comprising means for conveying vegetables one at a time to a point defining the start of a predetermined path, a series of rings surrounding said path, a plurality of nozzle means carried by each of said rings arranged around said path for respectively generating jets of water intersecting at said path, and cutting means at the end of said path.

16. The vegetable cutting system of claims 15, wherein said path is substantially straight and vertical.

17. The vegetable cutting system of claim 15, wherein the orientation of each of said nozzle means is such as to create a jet of water at an acute angle with respect to said path and directed toward said cutting means.

18. The vegetable cutting system of claim 17, wherein said acute angle is about 30°.

19. The vegetable cutting system of claim 15, and comprising at least two spaced-apart sets of said nozzle means for generating jets of water intersecting respectively at two points in said path.

20. The vegetable cutting system of claim 19, comprising six nozzle means in each set.

21. The vegetable cutting system of claim 20, wherein said nozzle means at each level are substantially equiangularly spaced apart.

22. The vegetable cutting system of claim 15, comprising a plurality of spaced-apart sets of said nozzle means for generating jets of water intersecting respectively at a plurality of points in said path.

23. The vegetable cutting system of claim 22, comprising four sets of said nozzle means.

24. The vegetable cutting system of claim 23, comprising six nozzle means in each set.

25. The vegetable cutting system of claim 24, comprising first and second and third and fourth spaced apart sets of said nozzle means for generating jets of water intersecting respectively at four points in said path, the nozzle means of said first and third sets being aligned and the nozzle means of said second and fourth sets being aligned.

26. The vegetable cutting system of claim 25, wherein the nozzle means of said first and second sets are about 30° out of phase with the nozzle means of said second and fourth sets.

27. The vegetable cutting system of claim 26, wherein the velocity of each of said jets of water is greater than the velocity of the vegetables along said path.

28. The vegetable cutting system of claim 15, wherein each of said rings is generally ovoid shaped.

29. The vegetable cutting system of claim 15, and further comprising a manifold coupled to said rings for delivering water under pressure thereto.

30. The vegetable cutting system of claim 15, wherein each of said rings has an input conduit for receiving water.

31. A vegetable cutting system comprising means for conveying vegetables one at a time to a point defining the start of a predetermined path, at least one set of nozzle means arranged around said path for generating jets of water intersecting at a point in said path, cutting means at the end of said path, and orienting means between said nozzle means and said cutting means for guiding the vegetables thereto and for accommodating transverse passage of water.

32. The vegetable cutting system of claim 31, wherein said orienting means includes a plurality of rods arranged substantially in a circle and extending substantially parallel to said path.

33. The vegetable cutting system of claim 32, wherein the radius of said circle is fixed.

34. The vegetable cutting system of claim 32, wherein the radius of said circle is adjustable.

35. The vegetable cutting system of claim 31, wherein said orienting means is readily removable.

36. The vegetable cutting system of claim 31, wherein said orienting means includes a plurality of spaced arcuate plates arranged substantially in a circle.

37. The vegetable cutting system of claim 36, wherein said orienting means includes three arcuate plates.

38. The vegetable cutting system of claim 37, wherein said arcuate plates are laterally adjustable.

39. The vegetable cutting system of claim 31, wherein said orienting means includes a plurality of spaced arcuate plates arranged in a circle and a plurality of rods extending from said plates substantially parallel to said path.

40. The vegetable cutting system of claim 31, wherein said path is vertical.

* * * * *